US009293252B2

(12) United States Patent
Kuniyoshi

(10) Patent No.: US 9,293,252 B2
(45) **Date of Patent: *Mar. 22, 2016**

(54) R-T-B SINTERED MAGNET MANUFACTURING METHOD

(75) Inventor: Futoshi Kuniyoshi, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/823,153

(22) PCT Filed: Sep. 29, 2011

(86) PCT No.: PCT/JP2011/072318

§ 371 (c)(1),
(2), (4) Date: Mar. 14, 2013

(87) PCT Pub. No.: WO2012/043692

PCT Pub. Date: Apr. 5, 2012

(65) Prior Publication Data

US 2013/0171342 A1 Jul. 4, 2013

(30) Foreign Application Priority Data

Sep. 30, 2010 (JP) ..... 2010-220792

(51) Int. Cl.

| | |
|---|---|
| ***H01F 41/00*** | (2006.01) |
| ***C22C 38/00*** | (2006.01) |
| ***C22C 38/06*** | (2006.01) |

(Continued)

(52) U.S. Cl.

CPC ..... *H01F 41/005* (2013.01); *C22C 38/005* (2013.01); *C22C 38/06* (2013.01); *C22C 38/10* (2013.01); *C22C 38/16* (2013.01);

(Continued)

(58) Field of Classification Search

None

See application file for complete search history.

(56) References Cited

U.S. PATENT DOCUMENTS

| | | | | |
|---|---|---|---|---|
| 4,380,559 | A * | 4/1983 | Mandai et al. | 427/80 |
| 8,801,870 | B2 * | 8/2014 | Sagawa | 148/101 |

(Continued)

FOREIGN PATENT DOCUMENTS

| | | | |
|---|---|---|---|
| CN | 101620904 | A | 1/2010 |
| JP | 2004-296973 | A | 10/2004 |

(Continued)

OTHER PUBLICATIONS

English translation of abstract for JP02-004433.*

(Continued)

*Primary Examiner* — Mandy Louie

(74) *Attorney, Agent, or Firm* — Keating & Bennett, LLP

(57) ABSTRACT

[Problem] To provide a heavy rare-earth element RH diffusion process that contributes greatly to mass production.

[Solution] A method for producing a sintered magnet includes the steps of: providing a sintered R-T-B based magnet body; providing an RH diffusion source which is made of at least one of a fluoride, an oxide and an oxyfluoride that each include Dy and/or Tb; loading the sintered R-T-B based magnet body and the RH diffusion source into a process chamber so that the magnet body and the diffusion source are movable relative to each other and are readily brought close to, or into contact with, each other; and performing an RH diffusion process in which the sintered R-T-B based magnet body and the RH diffusion source are heated to a processing temperature of 800° C. through 950° C. while being moved either continuously or discontinuously in the process chamber.

1 Claim, 1 Drawing Sheet

(51) Int. Cl.

| | |
|---|---|
| ***C22C 38/10*** | (2006.01) |
| ***C22C 38/16*** | (2006.01) |
| ***C22C 38/32*** | (2006.01) |
| ***H01F 41/02*** | (2006.01) |
| *H01F 1/057* | (2006.01) |

(52) U.S. Cl.

CPC ..... *C22C 38/32* (2013.01); *H01F 41/0293* (2013.01); *C22C 2202/02* (2013.01); *H01F 1/0577* (2013.01)

(56) References Cited

U.S. PATENT DOCUMENTS

| | | | | |
|---|---|---|---|---|
| 2002/0059965 | A1 | 5/2002 | Honkura et al. | |
| 2007/0240789 | A1 * | 10/2007 | Nakamura et al. ..... | 148/101 |
| 2008/0245442 | A1 | 10/2008 | Nakamura et al. | |
| 2009/0297699 | A1 | 12/2009 | Baba et al. | |
| 2012/0112863 | A1 | 5/2012 | Kuniyoshi | |

FOREIGN PATENT DOCUMENTS

| | | | | |
|---|---|---|---|---|
| JP | 2004296973 | * | 10/2004 | ..... H01F 1/06 |
| JP | 2006-303197 | A | 11/2006 | |
| JP | 2009-194262 | A | 8/2009 | |

OTHER PUBLICATIONS

Hirota "Coercivity enhancement by the grain boundary diffusion process to NDFEB sintered magnets" IEEE Transaction on magnetics vol. 42 No. 10 Oct. 2006. p. 2909-2911.*

English translation of JP 2004-296973. Accessed by examiner Nov. 28, 2015.*

English translation of Official Communication issued in corresponding International Application PCT/JP2011/072318, issued on Apr. 9, 2013.

Official Communication issued in International Patent Application No. PCT/JP2011/072318, mailed on Dec. 20, 2011.

* cited by examiner

R-T-B SINTERED MAGNET MANUFACTURING METHOD

TECHNICAL FIELD

The present invention relates to a method for producing a sintered R-T-B based magnet (where R is a rare-earth element and T is a transition metal element and includes Fe) including an $R_2T_{14}B$ type compound as its main phase.

BACKGROUND ART

A sintered R-T-B based magnet, including an $R_2T_{14}B$ type compound as a main phase, is known as a permanent magnet with the highest performance, and has been used in various types of motors such as a voice coil motor (VCM) for a hard disk drive and a motor for a hybrid car and in numerous types of consumer electronic appliances.

As a sintered R-T-B based magnet loses its coercivity at high temperatures, such a magnet will cause an irreversible flux loss. For that reason, when used in a motor, for example, the magnet should maintain coercivity that is high enough even at elevated temperatures to minimize the irreversible flux loss.

It is known that if R in the $R_2T_{14}B$ type compound phase is replaced with a heavy rare-earth element RH (which may be Dy and/or Tb), the coercivity of a sintered R-T-B based magnet will increase. It is effective to add a lot of such a heavy rare-earth element RH to the sintered R-T-B based magnet to achieve high coercivity at a high temperature.

However, if the light rare-earth element RL (which may be at least one of Nd and Pr) is replaced with the heavy rare-earth element RH as R in a sintered R-T-B based magnet, the coercivity certainly increases but the remanence decreases instead. Furthermore, as the heavy rare-earth element RH is one of rare natural resources, its use should be cut down.

Patent Document No. 1 discloses a technique for increasing the coercivity of a magnet. According to that technique, powder of an oxide, a fluoride, or an oxyfluoride of a heavy rare-earth element RH is put on the surface of a sintered magnet, and the sintered magnet is subjected to a heat treatment at a temperature that is equal to or lower than the sintering temperature of that sintered magnet in either a vacuum or an inert gas, thereby diffusing the heavy rare-earth element RH from the surface of the sintered magnet and increasing the coercivity of the magnet.

According to Patent Document No. 1, such a powder can be put on the surface of sintered magnet (as a powder processing method) by immersing the sintered magnet in a slurry, in which a fine powder of a heavy rare-earth element compound, including one or two or more of an oxide, a fluoride, and an oxy-fluoride, is dispersed in water or an organic solvent, drying the sintered magnet with hot air or in a vacuum, and then subjecting the magnet to a heat treatment so that the heavy rare-earth element RH is introduced through the surface of the magnet. According to Patent Document No. 1, a compound including a fluoride, in particular, can be absorbed into the magnet highly efficiently and the coercivity can be increased very effectively.

On the other hand, according to Patent Document No. 2, a sintered R-T-B based magnet is buried in an oxide or fluoride powder of a heavy rare-earth element RH and then subjected to a heat treatment at 500° C. to 1000° C. for 10 minutes to 8 hours in Ar or He, thereby forming an insulating layer in a surface region of the sintered magnet.

CITATION LIST

Patent Literature

Patent Document No. 1: WO 2006/043348

Patent Document No. 2: Japanese Laid-Open Patent Publication No. 2006-303197

SUMMARY OF INVENTION

Technical Problem

According to Patent Document No. 1, slurry of an oxide, fluoride or oxyfluoride of a heavy rare-earth element is prepared and applied onto a sintered magnet body. However, even if the heavy rare-earth element RH is made to diffuse from the surface of the sintered magnet body by applying the slurry only once, the effect of increasing the coercivity is just a limited one. That is why to increase the coercivity effectively enough by such a technique, the slurry needs to be applied over and over again.

Also, according to Patent Document No. 2, the sintered R-T-B based magnet is buried in an oxide powder or fluoride powder of a heavy rare-earth element, and therefore, it is difficult to control the rate of diffusion of the heavy rare-earth element RH from the surface of the sintered magnet. It is therefore an object of the present invention to provide a technique for diffusing a heavy rare-earth element RH constantly at a predetermined rate from the surface of a sintered R-T-B based magnet body.

Solution to Problem

A method for producing a sintered R-T-B based magnet according to the present invention includes the steps of:

providing a sintered R-T-B based magnet body;

providing an RH diffusion source which is made of at least one of a fluoride, an oxide and an oxyfluoride that each include Dy and/or Tb;

loading the sintered R-T-B based magnet body and the RH diffusion source into a process chamber so that the magnet body and the diffusion source are movable relative to each other and are readily brought close to, or into contact with, each other; and performing an RH diffusion process in which the sintered R-T-B based magnet body and the RH diffusion source are heated to a processing temperature of 800° C. through 950° C. while being moved either continuously or discontinuously in the process chamber.

In one embodiment, the RH diffusion process step is carried out with a stirring aid member introduced into the process chamber.

Advantageous Effects of Invention

According to the present invention, by adjusting the processing temperature and processing time of the RH diffusion process step, a heavy rare-earth element RH can be diffused into a sintered R-T-B based magnet body constantly at a predetermined rate, and therefore, a sintered R-T-B based magnet with high coercivity can be produced with good stability just as intended.

DESCRIPTION OF EMBODIMENTS

Figure 1:
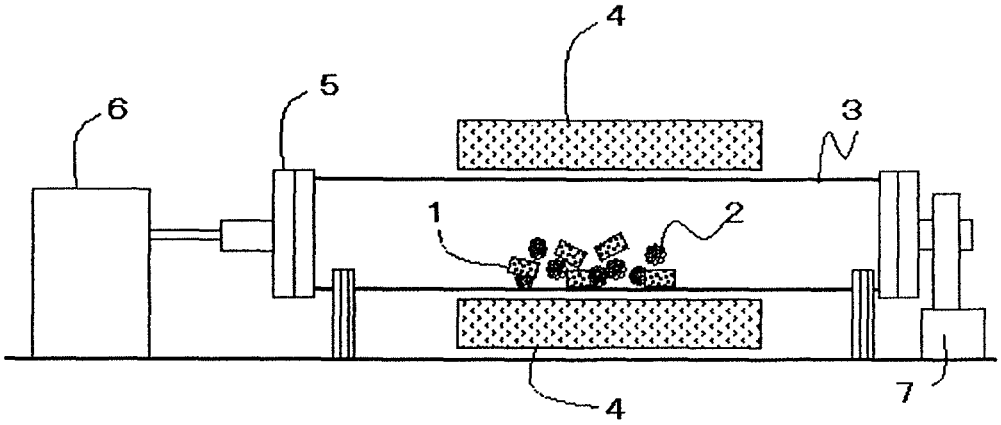
[FIG. 1] A cross-sectional view schematically illustrating a configuration for a diffusion system for use in a preferred embodiment of the present invention.

In a method for producing a sintered R-T-B based magnet according to the present invention, an RH diffusion source which is made of at least one of a fluoride, an oxide and an oxyfluoride that each include Dy and/or Tb and a sintered R-T-B based magnet body are loaded into a process chamber so as to be movable relative to each other and readily brought close to, or into contact with, each other, and are heated to a processing temperature of 800° C. through 950° C. while being moved either continuously or discontinuously in the process chamber.

According to the present invention, even if the RH diffusion source is made of at least one of a fluoride, an oxide and an oxyfluoride that each include Dy and/or Tb, the heavy rare-earth element RH can also be supplied by vaporization (sublimation) and diffused into the sintered R-T-B based magnet body in parallel (i.e., an RH diffusion process can be carried out).

In addition, according to the present invention, by adjusting the processing temperature and processing time, the RH diffusion process can be performed on the sintered R-T-B based magnet body with good stability.

Furthermore, according to the present invention, the RH diffusion source and the sintered R-T-B based magnet body are loaded into a process chamber so as to be movable relative to each other and readily brought close to, or into contact with, each other, and are moved either continuously or discontinuously in the process chamber. Thus, time for arranging the RH diffusion source and the sintered R-T-B based magnet body at predetermined positions can be saved.

According to the present invention, by moving the RH diffusion source which is made of at least one of a fluoride, an oxide and an oxyfluoride that each include Dy and/or Tb, along with the sintered R-T-B based magnet body, either continuously or discontinuously at a processing temperature of 800° C. to 950° C., the RH diffusion source and the sintered R-T-B based magnet body can be brought into contact with each other at an increased number of points in the process chamber. As a result, the heavy rare-earth element RH can be diffused inside the sintered R-T-B based magnet body. On top of that, in the temperature range of 800° C. to 950° C., the RH diffusion is promoted in the sintered R-T-B based magnet. That is why the RH diffusion process can be carried out under a condition where the heavy rare-earth element RH can be easily diffused inside the sintered R-T-B based magnet body.

Moreover, in the RH diffusion process step, the heavy rare-earth element RH is never supplied excessively onto the sintered R-T-B based magnet body and the remanence $B_r$ does not decrease, either.

As for a method for moving the sintered R-T-B based magnet body and the RH diffusion source in the process chamber either continuously or discontinuously in the RH diffusion process step, as long as the RH diffusion source and the sintered R-T-B based magnet body can have their relative positions changed without making the sintered R-T-B based magnet body chip or fracture, any arbitrary method may be used. For example, the process chamber may be rotated, rocked or subjected to externally applied vibrations. Alternatively, stirring means may be provided in the process chamber.

(Sintered R-T-B Based Magnet Body)

First of all, according to the present invention, a sintered R-T-B based magnet body in which the heavy rare-earth element RH needs to diffuse is provided. The sintered R-T-B based magnet body may have a composition including:

12 to 17 at % of a rare-earth element R;

5 to 8 at % of B (a portion of which may be replaced with C);

0 to 2 at % of an additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi); and T (which is a transition metal consisting mostly of Fe but which may include Co) and inevitable impurities as the balance.

In this composition, the rare-earth element R is comprised mostly of at least one element that is selected from the light rare-earth elements RL (Nd and Pr) but may possibly include a heavy rare-earth element as well. The heavy rare-earth element, if any, suitably includes at least one of Dy and Tb.

The sintered R-T-B based magnet body may be produced by a known manufacturing process.

(RH Diffusion Source)

The RH diffusion source is a compound of a heavy rare-earth element RH (which is Dy and/or Tb) and at least one of F and O. A compound of F and the heavy rare-earth element RH is typically, but does not have to be, $RHF_3$. A compound of O and the heavy rare-earth element RH is typically, but does not have to be, $RH_2O_3$. Alternatively, $RH_4O_4$ or $RH_4O_7$ may also be used, for example. An oxyfluoride including F and O is typically, but does not have to be, RHOF. Alternatively, the oxyfluoride may also be a compound of $RH_2O_3$ including a very small amount of F or a compound of $RH_2O_3$ including a lot of F to the contrary, which are produced while a rare-earth oxide and hydrous hydrofluoric acid are being heated to a high temperature.

Unless the effect of the present invention to be achieved by the heavy rare-earth element RH (which is Dy and/or Tb) is diminished, the RH diffusion source may include at least one element selected from the group consisting of Nd, Pr, La, Ce, Zn, Zr, Sn and Co. Also, the RH diffusion source may further include at least one transition metal element such as Al.

The RH diffusion source may have any arbitrary shape (e.g., in the shape of a ball, a wire, a plate, a block or powder), and its shape and size are not particularly limited. For example, the RH diffusion source, which is at least one of a fluoride, an oxide and an oxyfluoride that each include Dy and/or Tb, may be powder with a particle size of several μm, powder with a particle size of several hundred μm, or an even bigger block. A method of making the RH diffusion source will be described as an example. However, the RH diffusion source does not have to be made by the following method but may be made by any other method as well.

An oxide of the heavy rare-earth element is obtained by adding ammonium and ammonium hydrogen carbonate or ammonium carbonate to an aqueous solution of an inorganic salt of a rare-earth element to crystallize a carbonate salt of the rare-earth element, filtering and washing with water the carbonate salt, adding an organic solvent to the carbonate salt, heating the carbonate salt to remove its water, separating the organic solvent from a layer including the carbonate salt, and then drying and baking the carbonate salt at a reduced pressure.

A fluoride of the heavy rare-earth element is obtained by adding a compound that can produce hydrogen fluoride by dissociating in hydrofluoric acid or in water to a sol or slurry solution including a precipitate of a hydroxide of the rare-earth element, turning the precipitate into a fluoride, filtering and drying the fluoride, and if necessary, calcining the fluoride to a temperature of 700° C. or less.

An oxyfluoride of the heavy rare-earth element is obtained by either heating a rare-earth oxide and hydrous hydrofluoric acid to a high temperature (of 750° C., for example) or heating a fluoride to a high temperature.

Optionally, two or more of the fluoride, oxide and oxyfluoride of the heavy rare-earth element RH may be used in combination as the RH diffusion source.

(Stirring Aid Member)

In an embodiment of the present invention, it is recommended that a stirring aid member, as well as the sintered R-T-B based magnet body and the RH diffusion source, be introduced into the process chamber. The stirring aid member plays the roles of promoting the contact between the RH diffusion source and the sintered R-T-B based magnet body and indirectly supplying the heavy rare-earth element RH that has been once deposited on the stirring aid member itself to the sintered R-T-B based magnet body. Added to that, the stirring aid member also prevents chipping due to a collision between the sintered R-T-B based magnet bodies or between the sintered R-T-B based magnet body and the RH diffusion source in the process chamber.

The stirring aid member suitably has a shape that makes it easily movable in the process chamber. And it is effective to rotate, rock or shake the process chamber by combining that stirring aid member with the sintered R-T-B based magnet body and the RH diffusion source. Such a shape that makes the stirring aid member easily movable may be a sphere, an ellipsoid, or a circular cylinder with a diameter of a few hundred μm to several ten mm.

The stirring aid member is suitably made of a material that has a specific gravity of 6 g/cm$^3$ or more and that does not react easily with the sintered R-T-B based magnet body or the RH diffusion source even if the member contacts with the sintered R-T-B based magnet body or the RH diffusion source during the RH diffusion process. When made of a ceramic, the stirring aid member may be made of zirconia, silicon nitride, silicon carbide, boron nitride or a ceramic that includes any combination of these compounds.

Alternatively, when made of a metallic material that does not react easily with the sintered R-T-B based magnet body or the RH diffusion source, the stirring aid member may also be made of an element belonging to the group including Mo, W, Nb, Ta, Hf and Zr or a mixture thereof.

(RH Diffusion Process Step)

Hereinafter, a typical example of a diffusion process step according to the present invention will be described with reference to FIG. 1.

In the example illustrated in FIG. 1, sintered R-T-B based magnet bodies 1 and RH diffusion sources 2 have been loaded into a cylinder 3 of stainless steel. Although not shown in FIG. 1, it is recommended that zirconia balls be introduced as stirring aid members into the cylinder 3. In this example, the cylinder 3 functions as the "process chamber". The cylinder 3 does not have to be made of stainless steel but may also be made of any other arbitrary material as long as the material has thermal resistance that is high enough to withstand a temperature of 800° C. to 950° C. and hardly reacts with the sintered R-T-B based magnet bodies 1 or the RH diffusion sources 2. For example, the cylinder 3 may also be made of Nb, Mo, W or an alloy including at least one of these elements. The cylinder 3 has a cap 5 that can be opened and closed or removed. Optionally, projections may be arranged on the inner wall of the cylinder 3 so that the RH diffusion sources and the sintered R-T-B based magnet bodies can move and contact with each other efficiently. A cross-sectional shape of the cylinder 3 as viewed perpendicularly to its longitudinal direction does not have to be circular but may also be elliptical, polygonal or any other arbitrary shape. In the example illustrated in FIG. 1, the cylinder 3 is connected to an exhaust system 6. The exhaust system 6 can reduce the pressure inside of the cylinder 3. An inert gas such as Ar may be introduced from a gas cylinder (not shown) into the cylinder 3.

The cylinder 3 is heated by a heater 4, which is arranged around the outer periphery of the cylinder 3. When the cylinder 3 is heated, the sintered R-T-B based magnet bodies 1 and the RH diffusion sources 2 that are housed inside the cylinder 3 are also heated. The cylinder 3 is supported rotatably on its center axis and can also be rotated by a variable motor 7 even while being heated by the heater 4. The rotational velocity of the cylinder 3, which is represented by a surface velocity at the inner wall of the cylinder 3, may be set to be 0.01 m per second or more. The rotational velocity of the cylinder 3 is suitably set to be 0.5 m per second or less so as to prevent the sintered R-T-B based magnet bodies in the cylinder from colliding against each other violently and chipping due to the rotation.

In the example illustrated in FIG. 1, the cylinder is supposed to be rotating. However, this is only an example of the present invention. Alternatively, as long as the sintered R-T-B based magnet bodies 1 and the RH diffusion sources 2 are movable relative to each other and can contact with each other in the cylinder 3 during the RH diffusion process, the cylinder 3 does not always have to be rotated but may also be rocked or shaken. Or the cylinder 3 may even be rotated, rocked and/or shaken in combination.

Next, it will be described how to carry out an RH diffusion process using the processing apparatus shown in FIG. 1.

First of all, the cap 5 is removed from the cylinder 3, thereby opening the cylinder 3. And after multiple sintered R-T-B based magnet bodies 1 and RH diffusion sources 2 have been loaded into the cylinder 3, the cap 5 is attached to the cylinder 3 again. Then the inner space of the cylinder 3 is evacuated with the exhaust system 6 connected. When the internal pressure of the cylinder 3 becomes sufficiently low, the exhaust system 6 is disconnected. After that, with an inert gas introduced to a specified pressure, the cylinder 3 is heated by the heater 4 while being rotated by the motor 7.

During the RH diffusion process, an inert atmosphere is suitably maintained in the cylinder 3. In this description, the "inert atmosphere" refers to a vacuum or an inert gas. Also, the "inert gas" may be a rare gas such as argon (Ar) gas but may also be any other gas as long as the gas is not chemically reactive between the sintered R-T-B based magnet bodies 1 and the RH diffusion sources 2. The pressure of the inert gas is suitably equal to or lower than the atmospheric pressure. Since the RH diffusion sources 2 and the sintered R-T-B based magnet bodies 1 are arranged either close to, or in contact with, each other, according to this embodiment, the RH diffusion process can be carried out at a high pressure. Also, there is relatively weak correlation between the degree of vacuum and the rate of the heavy rare-earth element RH supplied. Thus, even if the degree of vacuum were further increased, the rate of the heavy rare-earth element RH supplied (and eventually the degree of increase in coercivity) would not change significantly. The supply rate is more sensitive to the temperature of the sintered R-T-B based magnet bodies than the pressure of the atmosphere.

According to this embodiment, RH diffusion sources 2, which are made of at least one of a fluoride, an oxide and an oxyfluoride that each include Dy and/or Tb as a heavy rare-earth element RH, and sintered R-T-B based magnet bodies 1 are heated to a processing temperature of 800° C. to 950° C. while being moved either continuously or discontinuously in a cylinder (process chamber) 3, thereby supplying the heavy rare-earth element RH from the RH diffusion sources 2 onto the surface of the sintered R-T-B based magnet bodies 1 directly and diffusing the heavy rare-earth element RH inside of the sintered R-T-B based magnet bodies in parallel.

During the diffusion process, the surface velocity at the inner wall of the process chamber may be set to be 0.01 m/s or more, for example. If the rotational velocity were too low, the point of contact between the sintered R-T-B based magnet bodies 1 and the RH diffusion sources 2 would shift so slowly as to cause adhesion between them easily. That is why the higher the diffusion temperature, the higher the rotational velocity of the process chamber should be. A suitable rotational velocity varies according to not just the diffusion temperature but also the shape and size of the RH diffusion source as well.

In this embodiment, the temperature of the RH diffusion sources 2 and the sintered R-T-B based magnet bodies 1 is maintained within the range of 800° C. to 950° C. This is a proper temperature range for the heavy rare-earth element RH to diffuse inward in the internal structure of the sintered R-T-B based magnet bodies 1 through the grain boundary phase.

Each of the RH diffusion sources 2 is made of at least one of a fluoride, an oxide and an oxyfluoride that each include Dy and/or Tb. And the heavy rare-earth element RH would not be supplied excessively when the processing temperature is within the range of 800° C. to 950° C. According to the present invention, even if the RH diffusion sources 2 have a particle size of more than 100 μm, the effect of the RH diffusion process can still be achieved. The RH diffusion process may be carried out for 10 minutes to 72 hours, and suitably for 1 to 12 hours.

The amount of time for maintaining that temperature is determined by the ratio of the total volume of the sintered R-T-B based magnet bodies 1 loaded to that of the RH diffusion sources 2 loaded during the RH diffusion process step, the shape of the sintered R-T-B based magnet bodies 1, the shape of the RH diffusion sources 2, the rate of diffusion of the heavy rare-earth element RH into the sintered R-T-B based magnet bodies 1 through the RH diffusion process (which will be referred to herein as a "diffusion rate") and other factors.

The pressure of the ambient gas during the RH diffusion process step (i.e., the pressure of the atmosphere inside the process chamber) may be set to fall within the range of $10^{-3}$ Pa through the atmospheric pressure. The cylinder 3 is supposed to rotate throughout the RH diffusion process step in order to diffuse RH uniformly into the sintered R-T-B based magnet bodies loaded. Optionally, however, the cylinder 3 may stop rotating after the RH diffusion process step or keep rotating through the first and second heat treatments to be described below.

(First Heat Treatment)

Optionally, after the RH diffusion process step, the sintered R-T-B based magnet bodies 1 may be subjected to a first additional heat treatment in order to distribute more uniformly the heavy rare-earth element RH diffused. In that case, after the RH diffusion sources have been removed, the additional heat treatment is carried out within the temperature range of 800° C. to 950° C. in which the heavy rare-earth element RH can diffuse substantially. In this first heat treatment, no heavy rare-earth element RH is further supplied onto the sintered R-T-B based magnet bodies 1 but the heavy rare-earth element RH does diffuse inside of the sintered R-T-B based magnet bodies 1. As a result, the heavy rare-earth element RH diffusing can reach deep inside under the surface of the sintered magnets, and the magnets as a whole can eventually have increased coercivity. The first heat treatment may be carried out for a period of time of 10 minutes to 72 hours, for example, and suitably for 1 to 12 hours. In this case, the pressure of the atmosphere in the heat treatment furnace where the first heat treatment is carried out is equal to or lower than the atmospheric pressure and is suitably 100 kPa or less.

(Second Heat Treatment)

Also, if necessary, a second heat treatment may be further carried out at a temperature of 400° C. to 700° C. However, if the second heat treatment (at 400° C. to 700° C.) is conducted, it is recommended that the second heat treatment be carried out after the first heat treatment (at 800° C. to 950° C.). The first heat treatment (at 800° C. to 950° C.) and the second heat treatment (at 400° C. to 700° C.) may be performed in the same process chamber. The second heat treatment may be performed for a period of time of 10 minutes to 72 hours, and suitably performed for 1 to 12 hours. In this case, the pressure of the atmosphere in the heat treatment furnace where the second heat treatment is carried out is equal to or lower than the atmospheric pressure.

EXAMPLES

Experimental Example 1

First of all, a sintered R-T-B based magnet body, having a composition consisting of 26.0 mass % of Nd, 4.0 mass % of Pr, 0.5 mass % of Dy, 1.0 mass % of B, 0.9 mass % of Co, 0.1 mass % of Al, 0.1 mass % of Cu, and Fe as the balance, was made. Next, the sintered magnet body was machined, thereby obtaining cubic sintered R-T-B based magnet bodies with a size of 7.4 mm×7.4 mm×7.4 mm. The magnetic properties of the sintered R-T-B based magnet bodies thus obtained were measured with a B-H tracer after the heat treatment (at 500° C.). As a result, the sintered R-T-B based magnet bodies had a coercivity $H_{cJ}$ of 1050 kA/m and a remanence $B_r$ of 1.42 T.

Next, an RH diffusion process was carried out using the machine shown in FIG. 1. The cylinder had a volume of 128000 $mm^3$, the weight of the sintered R-T-B based magnet bodies loaded was 50 g, and the weight of the RH diffusion sources loaded was 50 g. The RH diffusion sources used had an various shape.

When the RH diffusion process was carried out using various RH diffusion sources (representing Samples #1 through #11), the results shown in the following Table 1 were obtained. Even though their actual size was several μm, the RH diffusion sources passed through a sieve with an opening size of 25 μm compliant with the JIS Z-8801 standard as for Samples #1 through #8 and #11. RH diffusion sources with a size of 106 μm to 150 μm were used for Sample #9. And RH diffusion sources with a size of 250 μm to 325 μm were used for Sample #10.

Figure 2:
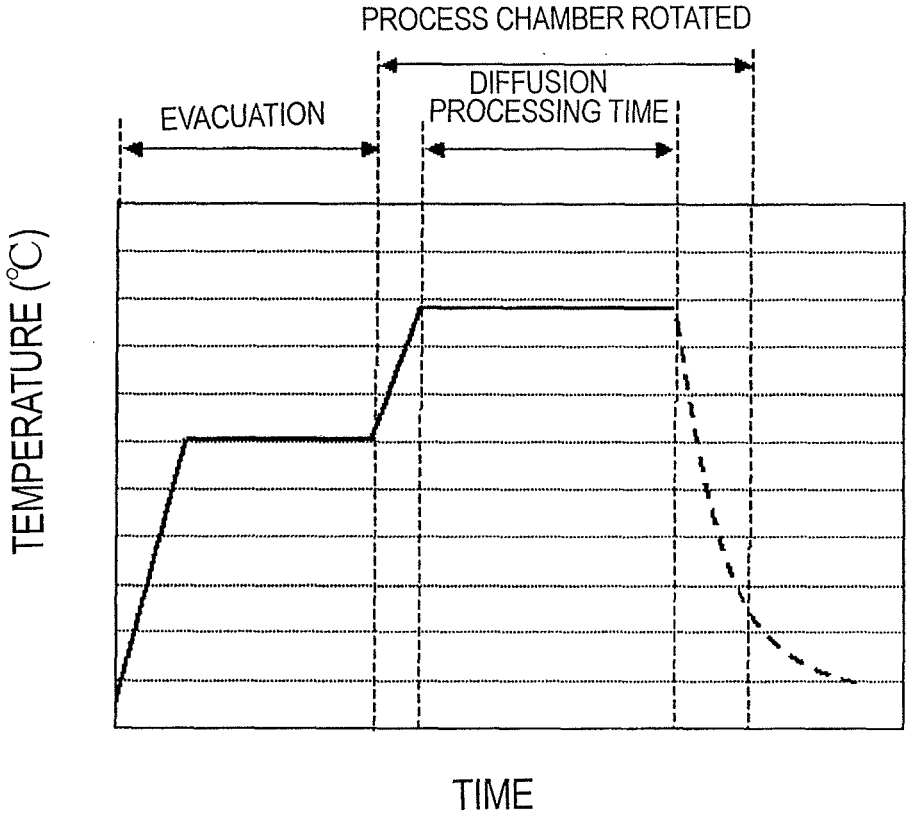
[FIG. 2] A graph showing an example of a heat pattern to adopt in a diffusion process step.

In the RH diffusion process, the temperature in the process chamber changed as shown in FIG. 2, which is a graph showing a heat pattern that represents how the temperature in the process chamber changed after the heating process was started. In the example illustrated in FIG. 2, evacuation was carried out while the temperature was being raised by a heater at a temperature increase rate of approximately 10° C. per minute. Next, until the pressure in the process chamber reaches a predetermined level, the temperature was maintained at about 600° C., for example. Thereafter, the process chamber started to be rotated, and the temperature was raised to an RH diffusion processing temperature at a temperature increase rate of approximately 10° C. per minute. When the RH diffusion processing temperature was reached, that temperature was maintained for a predetermined period of time. Thereafter, the heating process by the heater was stopped and the temperature was lowered to around room temperature. After that, the sintered magnet bodies were unloaded from the machine shown in FIG. 1, loaded into another heat treatment furnace, subjected to the first heat treatment at the same ambient gas pressure as in the RH diffusion process (at 800° C. to 950° C.×4 to 6 hours), and then subjected to the second heat treatment after the diffusion process (at 450° C. to 550° C.×3 to 5 hours). In this case, the processing temperatures and times of the first and second heat treatments were set with the weights of the sintered R-T-B based magnet bodies and RH diffusion sources loaded, the composition of the RH diffusion sources, and the RH diffusion temperature taken into account.

The magnetic properties shown in Table 1 were measured in the following manner. Specifically, the magnet body had its each side ground by 0.2 mm after the diffusion process to be machined into a cubic shape of 7.0 mm×7.0 mm×7.0 mm, and then had its magnetic properties measured with a B-H tracer. In Table 1, the "RH diffusion source" column shows the composition and size of the RH diffusion source that was used in the diffusion process step. The "surface velocity" column tells the surface velocity at the inner wall of the cylinder 3 shown in FIG. 1. The "RH diffusion temperature" column indicates the temperature in the cylinder 3 that was maintained in the diffusion process. The "RH diffusion time" column indicates how long the RH diffusion temperature was maintained. The "ambient gas pressure" column indicates the pressure when the diffusion process was started. The degree of increase in coercivity $H_{cJ}$ as a result of the RH diffusion process is indicated by "$\Delta H_{cJ}$" and the degree of increase in remanence $B_r$ as a result of the RH diffusion process is indicated by "$\Delta B_r$". A negative numerical value indicates that the magnetic property decreased compared to the sintered R-T-B based magnet body yet to be subjected to the RH diffusion process.

TABLE 1

| Sample | RH diffusion source Compositional formula | Surface velocity (m/s) | RH diffusion temperature (° C.) | RH diffusion processing time (hr) | Ambient gas pressure (Pa) | $\Delta H_{cJ}$ (kA/m) | $\Delta B_r$ (T) |
|---|---|---|---|---|---|---|---|
| 1 | $DyF_3$ | 0.02 | 920 | 6 | 0.5 | 258 | 0 |
| 2 | $DyF_3$ | 0.02 | 920 | 3 | 0.5 | 178 | 0 |
| 3 | $TbF_3$ | 0.02 | 920 | 6 | 0.5 | 402 | 0 |
| 4 | $Dy_2O_3$ | 0.02 | 920 | 6 | 0.5 | 230 | 0 |
| 5 | $Tb_4O_7$ | 0.02 | 920 | 6 | 0.5 | 397 | 0 |
| 6 | $Dy_{0.5}Tb_{0.5}F_3$ | 0.02 | 920 | 6 | 0.5 | 335 | 0 |
| 7 | $DyF_3$ | 0.02 | 920 | 6 | 100 | 263 | 0 |
| 8 | $TbF_3$ | 0.02 | 950 | 6 | 100000 | 410 | −0.01 |
| 9 | $DyF_3$ | 0.02 | 920 | 6 | 0.5 | 264 | 0 |
| 10 | $TbF_3$ | 0.02 | 950 | 6 | 0.5 | 440 | −0.01 |
| 11 | DyOF | 0.02 | 920 | 6 | 0.5 | 218 | 0 |

As can be seen from Table 1, in the range of the present invention, the decrease in remanence could be checked and the coercivity increased. Also, as can be seen from the result obtained for Samples #1 and #2, the degree of increase in coercivity $H_{cJ}$ after the RH diffusion process could be adjusted just by changing the RH diffusion processing time. Meanwhile, as can be seen from the result obtained for Samples #7 and #8, the effects of the present invention could also be achieved even when the ambient gas pressure was high. Furthermore, as can be seen from the result obtained for Samples #9 and #10, the effects of the present invention could be achieved irrespective of the size of the RH diffusion source.

Experimental Example 2

The RH diffusion process and the first heat treatment were carried out under the same condition as in Experimental Example 1 described above except that a sphere of zirconia with a diameter of 5 mm and a weight of 50 g was added as a stirring aid member, and the magnetic properties were measured. The results are shown in the following Table 2. Even though their actual size was several μm, the RH diffusion sources passed through a sieve with an opening size of 25 μm compliant with the JIS Z-8801 standard as for Samples #12 through #18 and #21. RH diffusion sources with a size of 106 μm to 150 μm were used for Sample #19. And RH diffusion sources with a size of 250 μm to 325 μm were used for Sample #20.

As can be seen from Table 2, even though the RH diffusion process was carried out on Samples #12 through #20 for only a half as long a time as on Samples #1 through #10, $H_{cJ}$ could be increased significantly in a short time and $B_r$ hardly decreased.

Also, comparing Sample #12 in Table 2 to Sample #2 in Table 1, it was discovered that RH could be increased per unit time with spheres of zirconia, each having a diameter of 5 mm, introduced. This is probably because the spheres of zirconia functioning as stirring aid members would have promoted contact between the RH diffusion sources and the sintered R-T-B based magnet bodies and would have supplied the heavy rare-earth element RH that had been deposited on themselves onto the sintered magnet bodies indirectly. On top of that, it was also discovered that chipping occurred much less often than in Experimental Example 1.

Also, as for Sample #21, the RH diffusion source of $DyF_3$ used in Sample #12 and the RH diffusion source of $Dy_2O_3$ used in Sample #14 were used in combination at a mixture ratio of one to one. Even in Sample #21, the coercivity could be increased with decrease in remanence minimized.

TABLE 2

| Sample | RH diffusion source Compositional formula | Surface velocity (m/s) | RH diffusion temperature (° C.) | RH diffusion processing time (hr) | Ambient gas pressure (Pa) | $\Delta H_{cJ}$ (kA/m) | $\Delta B_r$ (T) | Diffusion aid member |
|---|---|---|---|---|---|---|---|---|
| 12 | $DyF_3$ | 0.02 | 920 | 3 | 0.5 | 250 | 0 | YES |
| 13 | $TbF_3$ | 0.02 | 920 | 3 | 0.5 | 398 | 0 | YES |
| 14 | $Dy_2O_3$ | 0.02 | 920 | 3 | 0.5 | 235 | 0 | YES |
| 15 | $Tb_4O_7$ | 0.02 | 920 | 3 | 0.5 | 380 | 0 | YES |
| 16 | $Dy_{0.5}Tb_{0.5}F_3$ | 0.02 | 920 | 3 | 0.5 | 322 | 0 | YES |
| 17 | $DyF_3$ | 0.02 | 920 | 3 | 100 | 252 | 0 | YES |
| 18 | $TbF_3$ | 0.02 | 950 | 3 | 100000 | 410 | −0.01 | YES |
| 19 | $DyF_3$ | 0.02 | 920 | 3 | 0.5 | 251 | 0 | YES |
| 20 | $TbF_3$ | 0.02 | 950 | 3 | 0.5 | 440 | −0.01 | YES |
| 21 | $DyF_3$, $Dy_2O_3$ | 0.02 | 950 | 3 | 0.5 | 240 | 0 | YES |

As can be seen from these results, if RH diffusion sources, which are made of at least one of a fluoride, an oxide and an oxyfluoride that each include Dy and/or Tb, and sintered R-T-B based magnet bodies are brought into contact with each other in the heated process chamber and if their points of contact are not fixed, the heavy rare-earth element RH can be introduced effectively into the grain boundary of the sintered magnet bodies by a method that contributes to mass production, and eventually the magnetic properties can be improved.

The heat pattern that can be adopted in the diffusion process of the present invention does not have to be the example shown in FIG. 2 but may be any of various other patterns. Also, the vacuum evacuation may be performed until the diffusion process gets done and the sintered magnet body gets cooled sufficiently.

INDUSTRIAL APPLICABILITY

According to the present invention, a sintered R-T-B based magnet can be produced with stability so that its remanence and coercivity are both high. The sintered magnet of the present invention can be used effectively in various types of motors such as a motor for a hybrid car to be exposed to high temperatures and in numerous kinds of consumer electronic appliances.

REFERENCE SIGNS LIST

1 sintered R-T-B based magnet body
2 RH diffusion source
3 cylinder made of stainless steel (process chamber)
4 heater
5 cap
6 exhaust system

The invention claimed is:

1. A method for producing a sintered R-T-B based magnet, the method comprising the steps of:

providing a sintered R-T-B based magnet body;

providing an RH diffusion source which is made of at least one of a fluoride, an oxide and an oxyfluoride that each include Dy and/or Tb;

loading the sintered R-T-B based magnet body and the RH diffusion source into a process chamber so that the magnet body and the diffusion source are movable relative to each other and are readily brought close to, or into contact with, each other; and performing an RH diffusion process in which the sintered R-T-B based magnet body and the RH diffusion source are heated to a processing temperature of 800° C. through 950° C. while being moved either continuously or discontinuously in the process chamber so that the magnet body and the diffusion source are moved relative to each other and are brought close to, or into contact with, each other; wherein in the RH diffusion process, the process chamber is heated by a heater that is arranged around an outer periphery of the process chamber, the sintered R-T-B based magnet body and the RH diffusion source that are loaded into the process chamber are also heated, and the temperature of the sintered R-T-B based magnet body and the RH diffusion source is maintained within a range of 800° C. to 950° C.;

the RH diffusion process step is carried out using a stirring aid member loaded into the process chamber; and the stirring aid member is made of zirconia, silicon nitride, silicon carbide, boron nitride, or a ceramic that includes any combination of zirconia, silicon nitride, silicon carbide, boron nitride.

* * * * *